US008890688B2

(12) United States Patent
Schell

(10) Patent No.: US 8,890,688 B2
(45) Date of Patent: Nov. 18, 2014

(54) COMMUNICATING RADIO FREQUENCY MODEM FOR INTRUSION DETECTION AND TRACKING

(76) Inventor: Jerry Schell, Chanute, KS (US)

( * ) Notice: Subject to any disclaimer, the term of this patent is extended or adjusted under 35 U.S.C. 154(b) by 0 days.

(21) Appl. No.: 13/566,021

(22) Filed: Aug. 3, 2012

(65) Prior Publication Data

US 2014/0035743 A1 Feb. 6, 2014

(51) Int. Cl.
*G08B 13/00* (2006.01)

(52) U.S. Cl.
USPC ..... 340/541; 340/568.1; 340/568.2; 340/555; 340/565; 340/571

(58) Field of Classification Search
CPC ..... G08B 13/00; G08B 13/18; G08B 13/19; G08B 13/181; G08B 13/183–13/184; G08B 13/186–13/187; G08B 13/189; G08B 13/191; G08B 13/193; G08B 13/1445; G08B 13/1895; G08B 25/10; G01S 19/17; B60R 25/33; B60R 25/102
USPC ..... 340/539.1, 539.11, 539.13, 340/539.31–539.32, 540–542, 545.6, 340/568.1–568.2, 569–572.9, 10.1–10.52, 340/539.22, 539.26, 545.1–557, 561–568.3, 340/568.7; 109/21, 31, 38
See application file for complete search history.

(56) References Cited

U.S. PATENT DOCUMENTS 4,232,308 A * 11/1980 Lee et al. ..... 340/539.3
5,371,488 A * 12/1994 Couch et al. ..... 340/541
5,438,607 A * 8/1995 Przygoda et al. ..... 379/38
5,594,425 A * 1/1997 Ladner et al. ..... 340/539.18
5,646,592 A * 7/1997 Tuttle ..... 340/545.6
5,831,531 A * 11/1998 Tuttle ..... 340/568.2
6,075,458 A * 6/2000 Ladner et al. ..... 340/539.1
6,078,269 A * 6/2000 Markwell et al. ..... 340/517
6,583,813 B1 * 6/2003 Enright et al. ..... 348/150
6,833,788 B1 * 12/2004 Smith et al. ..... 340/541
7,147,147 B1 * 12/2006 Enright et al. ..... 235/379
7,229,012 B1 * 6/2007 Enright et al. ..... 235/379
7,389,914 B1 * 6/2008 Enright et al. ..... 235/379
7,533,805 B1 * 5/2009 Enright et al. ..... 235/379
7,533,806 B1 * 5/2009 Enright et al. ..... 235/379
7,595,816 B1 * 9/2009 Enright et al. ..... 348/150
7,900,823 B1 * 3/2011 Knouff et al. ..... 235/379
7,942,313 B1 * 5/2011 Grimm et al. ..... 235/379

(Continued)

FOREIGN PATENT DOCUMENTS

WO WO 2005/006273 A2 * 1/2005
WO WO 2005/012936 A2 * 2/2005 ..... G01S 5/02

*Primary Examiner* — Hai Phan
*Assistant Examiner* — Orlando Bousono
(74) *Attorney, Agent, or Firm* — H. Jay Spiegel

(57) ABSTRACT

A cellular modem may give notice of changes in modes. The modem will change modes as a result of the breaking of a trip wire or the closing of contacts that are normally open or the opening of contacts that are normally closed or sensing motion or light, or sensing variations in resistance. One contact is provided to wake the unit from "sleep" and the other is provided to detect intrusion, motion, etc. Light detectors can detect light, such as when a closed container is opened. Closed contacts can be used in parallel to change any mode or open/closed contacts in parallel/series. The modem can be used to apprehend people breaking into or stealing luggage, equipment, boxes, etc. The present invention informs the user when the object being monitored is being moved or opened and can track the object's location.

17 Claims, 4 Drawing Sheets

(56) References Cited

U.S. PATENT DOCUMENTS

| | | | | |
|---|---|---|---|---|
| 7,942,314 | B1 * | 5/2011 | Grimm et al. | 235/379 |
| 7,946,476 | B1 * | 5/2011 | Grimm et al. | 235/379 |
| 7,950,573 | B1 * | 5/2011 | Enright et al. | 235/379 |
| 7,984,847 | B1 * | 7/2011 | Knouff et al. | 235/379 |
| 8,302,854 | B1 * | 11/2012 | Grimm et al. | 235/379 |
| 8,396,766 | B1 * | 3/2013 | Enright et al. | 705/35 |
| 2005/0024202 | A1 * | 2/2005 | Culpepper et al. | 340/539.13 |
| 2005/0179548 | A1 * | 8/2005 | Kittel et al. | 340/568.2 |
| 2006/0261959 | A1 * | 11/2006 | Worthy et al. | 340/572.8 |
| 2007/0127774 | A1 * | 6/2007 | Zhang et al. | 382/103 |
| 2007/0268138 | A1 * | 11/2007 | Chung et al. | 340/572.1 |
| 2008/0158002 | A1 * | 7/2008 | Parkinson et al. | 340/825.49 |
| 2010/0026802 | A1 * | 2/2010 | Titus et al. | 348/143 |
| 2010/0033577 | A1 * | 2/2010 | Doak et al. | 348/159 |
| 2010/0097471 | A1 * | 4/2010 | Drive et al. | 348/159 |
| 2010/0164710 | A1 * | 7/2010 | Chung et al. | 340/539.1 |
| 2010/0194631 | A1 * | 8/2010 | Janetis et al. | 342/357.1 |
| 2010/0265068 | A1 * | 10/2010 | Brackmann et al. | 340/572.1 |
| 2010/0332359 | A1 * | 12/2010 | Powers et al. | 705/28 |
| 2012/0092130 | A1 * | 4/2012 | Chung et al. | 340/10.1 |
| 2012/0092161 | A1 * | 4/2012 | West | 340/540 |

* cited by examiner

COMMUNICATING RADIO FREQUENCY MODEM FOR INTRUSION DETECTION AND TRACKING

BACKGROUND OF THE INVENTION

The present invention relates to a communicating radio frequency modem for intrusion detection and tracking. In the prior art, it is separately known to provide means for sensing intrusion detection and means for tracking people or objects. However, Applicant is unaware of any system designed as a portable system allowing sensing of intrusions and tracking of objects using a variety of communications means.

The following prior art is known to Applicant:

U.S. Published Application No. US 2003/0104800 A1 to Zak discloses a telephone including a cell phone which includes emergency condition sensors such as motion, intrusion, smoke or fire sensors. In the event of a detected emergency, the system is programmed to dial the last number called, or a preset number and can also sound an audible alarm in the cellular phone. The present invention distinguishes from Zak since the present invention is not a phone and has less delay than phone call. In fact, the present invention is a cellular modem that transmits data, not phone conversations, and is not used to monitor homes, buildings, etc. It is intended to be used primarily to apprehend individuals transporting illegal drugs or other contraband. Law enforcement agencies work with freight companies to plant equipment in shipments to catch offenders in the act. The present invention can be employed by such law enforcement agencies to facilitate interception of shipments and to wire containers with aspects of the present invention which are then delivered to an addressee. When the addressee opens the shipment, this is proof of their intention to receive it and helps to facilitate criminal prosecution.

U.S. Pat. No. 7,151,460 to Mäkelä et al. disclose a portable device such as a cell phone which includes a smoke detection device in the form of a light emitter and light detector and can also serve as a proximity detector. When the detection aspect of the device is tripped, an alarm signal is produced. The present invention differs from the teachings of Mäkelä et al. since the present invention does not monitor a smoke detector. By contrast, the present invention has a light detector that is merely used to detect when someone opens a closed container. No light emitter is employed.

U.S. Pat. Nos. 7,646,297 and 8,089,355 both to Aaron both arose from a common application Ser. No. 11/611,434. These patents disclose portable devices such as cell phones having automatic self-configuration to adjust to the user's environmental circumstances. The present invention differs from the teachings of the Aaron patents because the inventive device does not monitor the user's environment nor does it automatically or self-configure. The present invention also does not use mode templates.

U.S. Published Application No. US 2011/0121965 A1 to Betts et al. discloses a personal electronic device having sensory systems that detect environmental events and provide a notification alert or corrective action in response. The present invention differs from the teachings of Betts et al. because the present invention does not monitor environmental events.

U.S. Published Application No. US 2011/0092248 to Evanitsky discloses a portable security system built into cell phones that includes the ability to capture images. The present invention differs from the teachings of Evanitsky since the present invention does not take pictures or capture video.

U.S. Published Application No. US 2011/0199304 to Walley et al. discloses systems and methods for providing enhanced motion detection. This device uses a camera as well. The present invention differs from the teachings of Walley et al. since the present invention does not employ a camera and the inventive motion sensor is only employed to determine whether a package or other object to which the present invention is affixed is moving or still. There is no enhanced motion detection incorporated into the teachings of the present invention.

U.S. Published Application No. US 2011/0210846 to Causey et al. discloses a mobile security system having a detector that may communicate with a mobile device if an event has occurred. Events may include fire or motion. The present invention differs from the teachings of Causey et al. since the present invention is not a security system nor does it have the ability to monitor events such as fires. This published application later matured into U.S. Pat. No. 7,952,476.

U.S. Pat. No. 7,531,007 to Sharma discloses a security apparatus using a telecommunication device which senses an undesired activity around or in association with the telecommunication device and causes the telephone microprocessor to send a predefined security message to alert concerning the undesired activity. The present invention differs from the teachings of Sharma since the present invention is not monitoring around a telecommunication device but, rather, is utilized in conjunction with sensors to detect intrusion or motion.

SUMMARY OF THE INVENTION

The present invention relates to a communicating radio frequency modem for intrusion detection and tracking. The present invention includes the following interrelated objects, aspects and features:

(1) In a first aspect, the present invention consists of a cellular modem including communication means provided with the ability to wirelessly give notice to a remote receiver, via signals, of changes in modes. The inventive modem will change modes as a result of a triggering condition sensed by sensing means such as the breaking of a trip wire or the closing of contacts that are normally open or the opening of contacts that are normally closed or sensing motion or light, or sensing variations in resistance. One contact is provided to wake the unit from "sleep" and the other is provided to detect intrusion, motion, etc. Light detectors can detect light, such as when a closed container is opened. Closed contacts can be used in parallel to change any mode or open/closed contacts in parallel/series. Triggering conditions are revealed to the modem via signals that are unique for each type of triggering condition.

(2) Other sensing means can include variable resistance devices, variable voltage devices or combinations of trip wires/contacts/light detection/motion detection/variable resistance/variable voltage devices may be employed to wake the unit so that it changes to a tracking mode or to detect intrusion so that it changes to an alarm mode.

(3) A change in mode may also include motion detection to notify if the unit is still or moving regardless of whether the unit is tracking or sensing intrusion. Initiation of motion can start the tracking mode from the sleep mode and can be considered by the device to be a change of mode.

(4) In the preferred embodiment of the present invention, there are six main modes:

(a) a sleep mode in which little current is expended and battery power is preserved;

(b) a tracking mode in which any one of a trip wire, accelerometer or a light detector is employed and signals no present intrusion, which mode operates both when still and when there is motion;

(c) a motion detecting mode that detects whether a package to which the inventive device is affixed is still or moving. When the package is still, subsequent motion can wake the unit to remotely notify of the change of mode as well as the change of mode from moving to still;

(d) an alarm mode in which, responsive to actuation of a trip wire and/or light detection when a package is opened, the enunciation changes to denote intrusion, which mode operates both when still and when there is motion.

(5) When the inventive radio frequency modem is activated, it is able to send location information such as latitude, longitude, and altitude along with the mode information concerning intrusion, light, motion, etc. Cell tower triangulation may be employed to locate the modem and, concurrently, the package in which it has been mounted.

(6) A back-up transmitter can augment cellular transmission to ensure that if cellular transmission is lost or the package is located in an area where cellular transmission does not exist, transmission can continue. Thus, a radio frequency (RF) transmitter may be provided.

(7) The inventive modem can also be used to apprehend people breaking into or stealing luggage, equipment, boxes, etc. The present invention informs the user when the object being monitored is being moved or opened.

As such, it is a first object of the present invention to provide a communicating modem for intrusion detection and tracking.

It is a further object of the present invention to provide such a device in which a sleep mode is provided or is included that precludes waste of battery power.

It is a yet further object of the present invention to provide such a modem that includes primary and back-up transmission capabilities to ensure reliability.

It is a still further object of the present invention to provide such a modem that can facilitate detection of intrusions as well as movements to enable the capture of criminals.

These and other objects, aspects and features of the present invention will be better understood from the following detailed description of the preferred embodiments when read in conjunction with the appended drawing figures.

SPECIFIC DESCRIPTION OF THE PREFERRED EMBODIMENTS

Figure 1A:
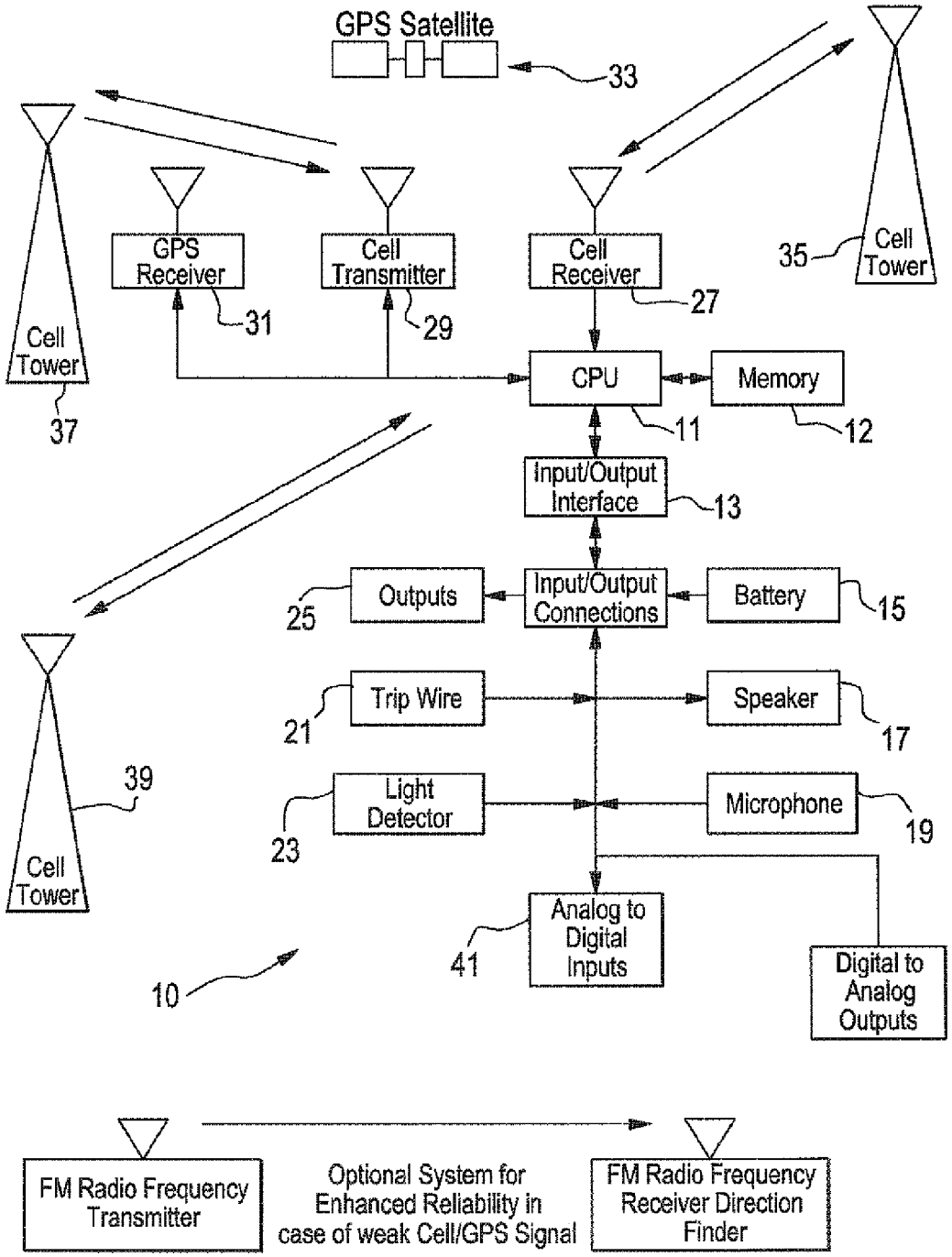
FIG. 1A shows a schematic representation of the communications network that is utilized in connection with the present invention.

With reference, first, to FIG. 1A, the inventive radio frequency modem is generally designated by the reference numeral 10 and is seen to include a central processing unit (CPU) 11 that includes an input/output interface 13 connecting the CPU 11 to a battery 15, speaker 17, microphone 19, trip wire 21, and, for example, a light detector 23. These connections also include general output connections 25 that may be used for additional outputs. The CPU 11 has an associated memory 12 and also connects with a cell receiver 27, a cell transmitter 29, and a global positioning system (GPS) receiver 31. The GPS receiver 31 wirelessly communicates with one or more GPS satellites 33 and the cellular transmitter 29 and cellular receiver 27 wirelessly communicate with a variety of cellular towers 35, 37 and 39. The CPU 11 is also provided with analog to digital outputs 41 that transform analog signals to digital signals for a variety of purposes as well understood by those skilled in the art.

Figure 1B:
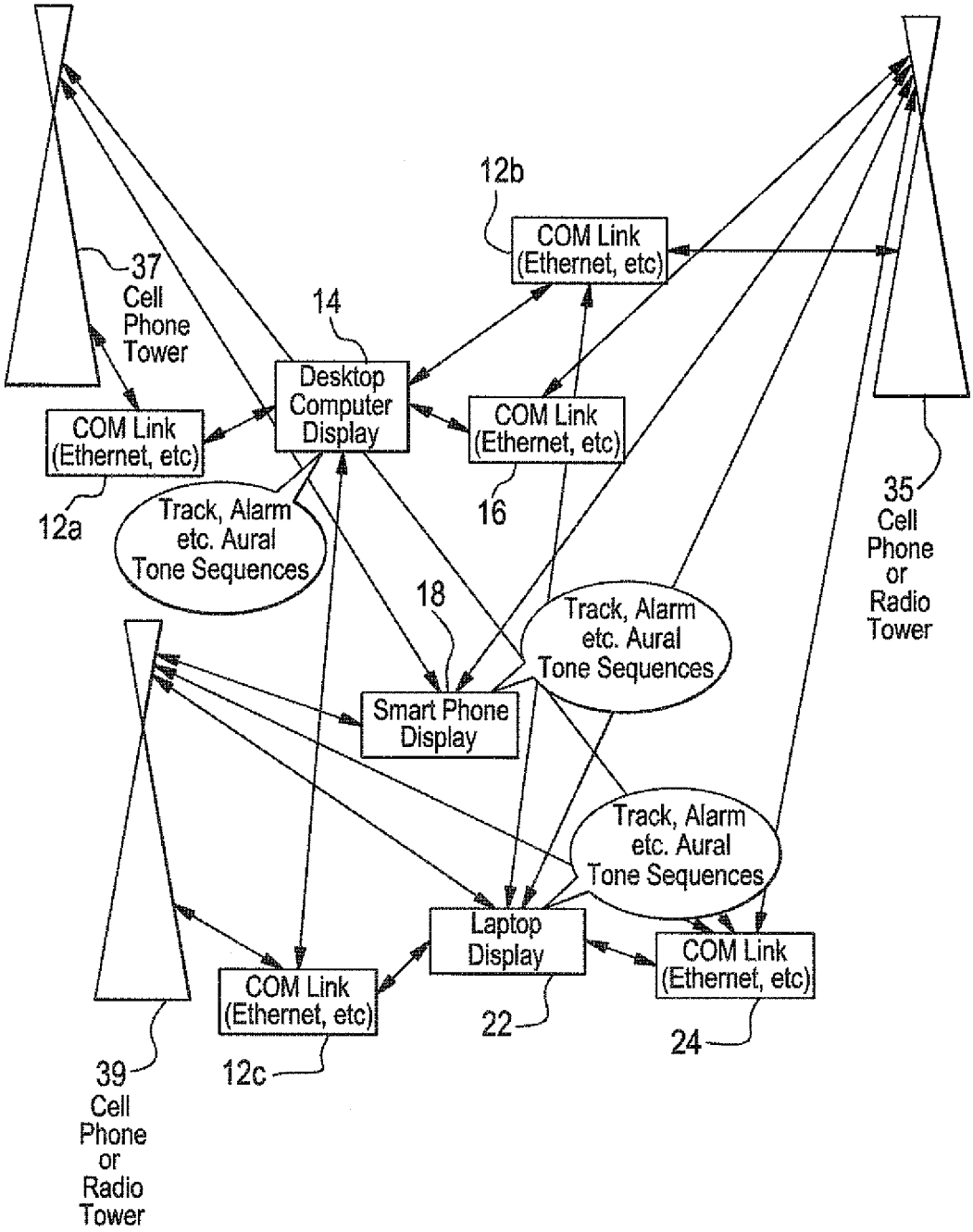
FIG. 1B shows a schematic representation of the tracker back end manner of communications.

With reference to FIG. 1B, depicted is the tracker back end diagram. As seen in FIG. 1B, the cell phone towers 35, 37 and 39 may also be radio towers. Cell modems 16 and 24 communicate with the towers 35, 37 and 39. The towers also communicate with the desktop computer display 14 and the laptop display 22, via the respective COM links 12*a*, 12*b* and 12*c* which may comprise Ethernet devices as is well known. The towers 35, 37 and 39 communicate with the smart phone 18 via the cell system as is well known.

The desktop computer display 14 and laptop display 22 output tracking and alarm data as well as aural tone sequences. The same is true of the smart phone display 18. The smart phone display 18, laptop display 22, and desktop computer display 14 communicate with the towers 35, 37 and 39 either directly or through the communications links 12*a*, 12*b*, 12*c* and then to the cellular modems 16 and 24 to control cellular modem outputs or to program the cellular modems.

Figure 2:
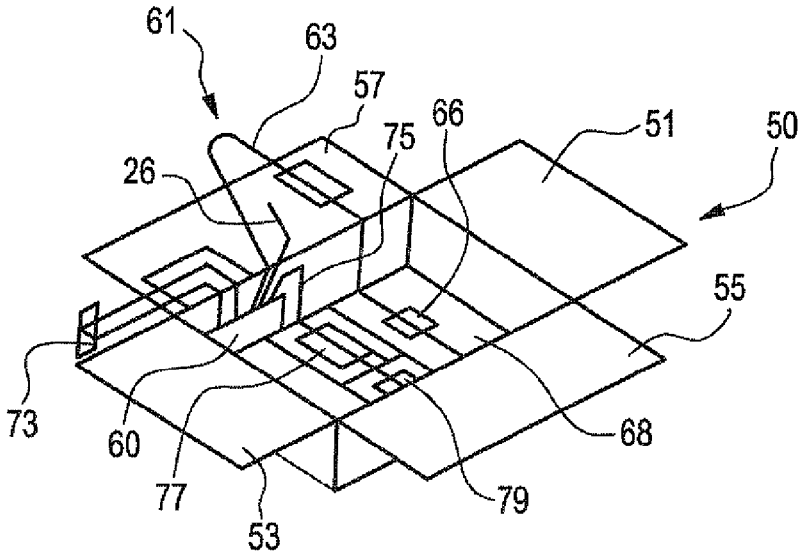
FIG. 2 shows a perspective view of a first example of an application of the present invention.
Figure 3:
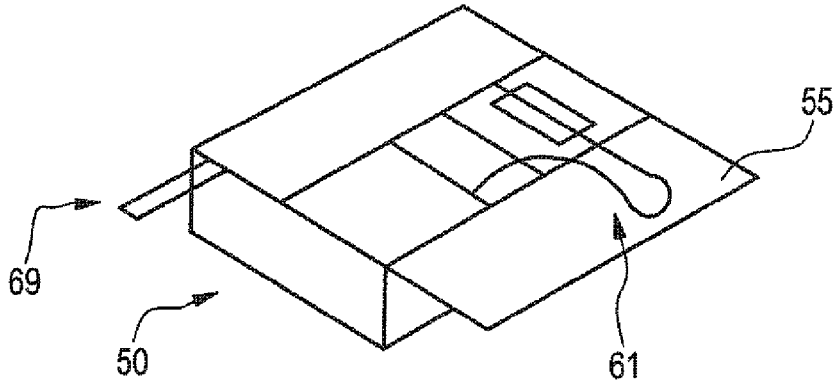
FIG. 3 shows a perspective view of a second example of an application of the present invention.
Figure 4:
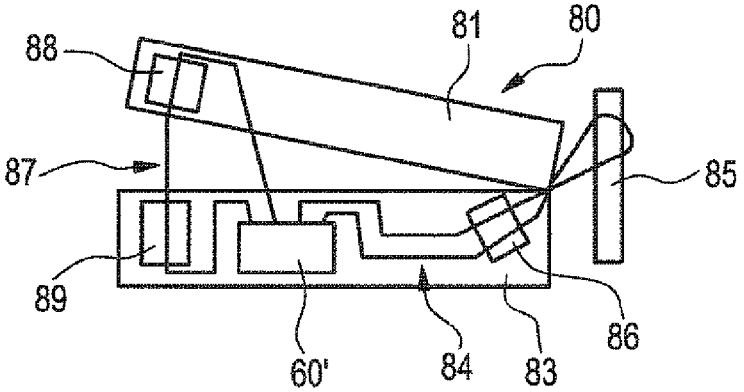
FIG. 4 shows a side view of a third example of an application of the present invention.

With reference now to FIGS. 2-4, various embodiments of applications of the present invention will now be explained.

With reference to FIG. 2, a container is generally designated by the reference numeral 50 and is seen to include end flaps 51 and 53 as well as side flaps 55 and 57. The container 50 also includes an interior 59.

In practicing the teachings of the present invention, a covert transmitter 60 is fastened inside the chamber 59 of the container 50 and has electrically connected to it a trip wire 61 having a loop 63 fastened in place with a piece of tape 65 on the side flap 57. The trip wire connects back to the transmitter 60 via its section 75 held in place with pieces of tape 77 and 79. A trip wire 69 is also fastened to the side flap 57 using tape 71 and has a loop fastened to a stationary object 73. The trip wire 69 is sufficiently long enough to reach the distance from the transmitter 60 to the stationary object 73 so that it can be looped there and back as shown in FIG. 2. The trip wire is attached to standby/transmit terminals on the transmitter 60. A small spacing, for example, one-half inch, is provided between wires to prevent slippage. The trip wire 61 is for sensing intrusion detection and includes a length of trip wire long enough to reach totally around the carton plus a couple of extra feet of distance. This wire is attached to alarm terminals of the covert transmitter 60. As seen in FIG. 2, the trip wire is fastened to the container 50 using tape 66 (FIG. 1). FIG. 3 shows an additional aspect in which the trip wire 61 is also looped around the flap 55.

The covert transmitter 60 is powered by batteries and has an antenna wire 26 (FIG. 2) attached thereto.

Of course, if desired, one or the other of the trip wires may be suitably employed or, preferably, both of them may be employed. In the preferred embodiment, the standby/transmit wire should be on the bottom of the container.

A different setup may be employed, with reference to FIG. 4, where the container to be protected is a briefcase 80. The briefcase 80 has a lid 81 as well as a containment 83. A standby/transmit trip wire 84 is attached to the covert transmitter 60' and is looped about a stationary object 85 and taped to the briefcase using tape 86. An alarm trip wire 87 is connected between the lid 81 and the containment 83, with tape 88 affixing the trip wire 87 to the lid 81, and with tape 89 affixing the trip wire 87 to the containment 83. If an unauthorized user opens the lid 81, the trip wire 87 senses this action and activates the covert transmitter. Additionally, if the briefcase 80 is moved from its position, the trip wire 84 will cause detection and activate the transmitter 60'.

Figure 5:
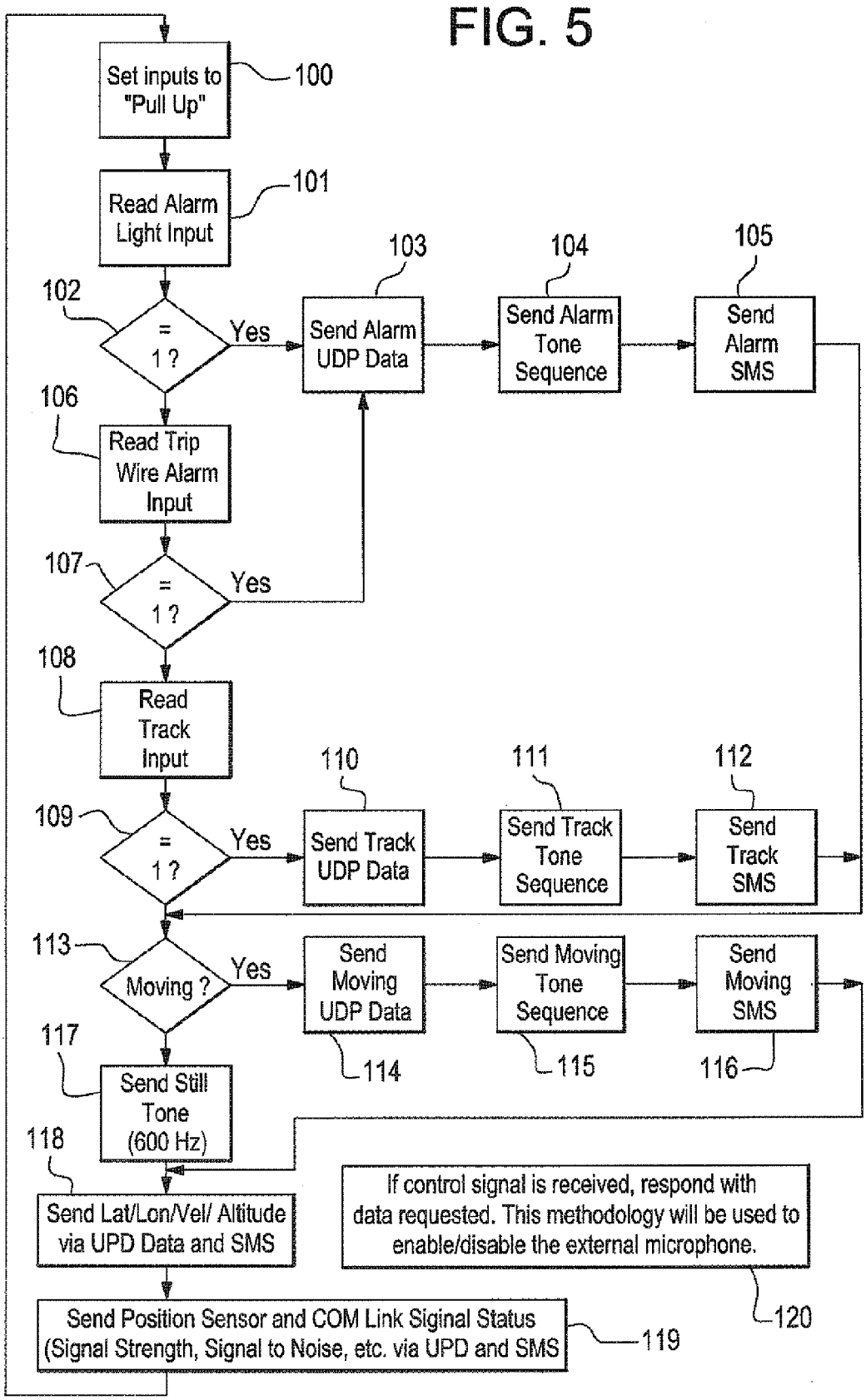
FIG. 5 shows a flowchart explaining the operation of the present invention.

With reference, now, to FIG. 5, a flowchart is depicted that explains the operation of the present invention. Starting with the upper left-hand corner of FIG. 5, one must first set inputs to "pull up" status. Next, light inputs are read, and the question is answered as to which data variable has been sensed. If an alarm has activated, the alarm input is read and then an instruction is given to send alarm user datagram protocol (UDP) data including sending an alarm tone and sending an alarm short message source (SMS). If not, the track input is read, and track UDP data is then sent including a track tone and track SMS.

If motion is sensed, motion UDP data is sent along with a particular moving tone and moving SMS. If the object to which the inventive device is affixed is maintained in a still configuration, a tone at a particular frequency such as 600 Hz is sent verifying that status.

Upon sensing of motion or intrusion, data may be sent concerning the status of the monitored device including alarm and track as well as the latitude (Lat), longitude (Lon), velocity (Vel), and altitude, with these values being compiled using transmission and receiving to and from GPS satellites and/or cell towers. Use of both GPS satellites and cell towers device location capabilities provides system redundancy to enhance reliability. Additionally, an RF transmitter may be employed, if necessary, to provide a further back-up. This comprises means for tracking package locations.

For use of the present invention, it is possible to set up an enhanced system to facilitate monitoring a package, container, briefcase, etc., and to learn remotely if that object has been intruded upon, has moved, or is being transported. Under these circumstances, alarms may be activated, and tracking may take place so that the object can be retrieved along with the alleged criminal who has absconded with it.

The types of sensors that may be employed in connection with the present invention include, but are not limited to, light detectors (to detect when a container has been opened), reed relays, Flail effect sensors, conductive contacts, variable resistance light receivers, photo array detectors, photo diode detectors, photo sensors, and photo receivers. Combinations of these sensors may be suitably employed depending upon the situation involved. One or more trip wires are employed with the number dictated by the scenario to be addressed. Any desired sensor of any type may suitably be employed depending upon the situation encountered.

In the sleep mode of the inventive modem, the system is not operable and consumes little, if any, power from its battery. To change the state of the device from sleep mode to tracking mode requires either movement of the modem itself or a change in the tracking input such as what would occur based upon tripping of a trip wire or activation of a light detector. When the device is in the tracking mode, it is operational and sending continuous data streams relating to physical exposure (whether it is moving or still). Movement and tracking mode information is also sent including GPS derived coordinates, altitude, speed, acceleration, deceleration, signal strength of cell signals, GPS signal strength, battery voltage level, movements of accelerometer, up/down, left/right, front/back, as well as information concerning triangulation between cell towers which may be employed to derive location data.

When the device is being used in an alarm mode, to change the state of the device from tracking mode to alarm mode requires a change in the alarm input such as what would occur through tripping of a trip wire or activation of a light detector as examples. When in the alarm mode, the inventive device is operational and sending data relating to whether the associated container is moving or still. Movement and alarm mode information is sent including GPS coordinates, altitude, speed, acceleration, deceleration, signal strength of cell signals, GPS signal strength, battery voltage level, movements of accelerometer, up/down, left/right, front/back, as well as information concerning triangulation between, and/or signal strength from cell towers which may be employed to derive location data.

The inventive modem is preferably configured to start operation in what would be best described as a "sleep mode" in which minimal battery power is being consumed. In the preferred embodiment, a minimum of two trip wires or other sensing detectors must be provided and must be un-activated to maintain the present invention in the sleep mode to conserve the battery. When one or the other or both of the inputs is/are activated, the modem will begin to transmit data in the tracking mode or the alarm mode depending upon which input has been compromised.

In a second possible configuration, the inventive modem is configured to start in the tracking mode. This mode is selected when operating time is shorter and the scenario is more calculated. In this configuration, the modem will require a minimum of one trip wire or other sensing detector to keep the device in the tracking mode. When one of the inputs is activated, the unit will go into the alarm mode.

As such, an invention has been disclosed in terms of preferred embodiments thereof which fulfill each and every one of the objects of the invention as set forth hereinabove, and provide a new and useful communicating modem for intrusion detection and tracking of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

The invention claimed is:

1. A modem for intrusion detection and tracking, comprising:

a) a modem removably attached on or within a container and switchable between a sleep mode and an active mode, said modem always connected to a source of power;

b) said modem including communication means for wirelessly transmitting in said active mode a first signal to a remote receiver responsive to sensing one or more triggering conditions;

c) plural sensing means connected to said modem for sensing said one or more triggering conditions, said plural sensing means being chosen form the group consisting of motion of said container, light shining on a light sensing means previously shielded from light, and intrusion into said container;

d) whereby, responsive to said plural sensing means sensing said one or more triggering conditions, (1) said plural sensing means send second signal to said modem which, responsive thereto, switches from said sleep mode to said active mode and then send said first signal to said remote receiver to notify said remote receiver that (a) said one or more triggering conditions has/have been sensed, and (b) identifying a particular triggering condition or particular triggering conditions from said one or more triggering conditions and identifying which one (s) of said motion of said container, said light shining on said light sensing means previously shielded from light, and/or said intrusion into said container which has/have been sensed, and (2) said modem activates means for tracking a location of said container, said means for tracking the location of said container being deactivated prior to its activation; and e) wherein said active mode comprises:

(1) a tracking mode in which any one of said plural sensing means is employed and signals no present intrusion, said tracking mode operating both when said container is still and when said container is in motion;

(2) a motion detecting mode that detects whether said container is still or in motion by notifying to the remote receiver when a change from still to moving or from moving to still has taken place; and (3) an alarm mode in which, responsive to actuation of any one of said plural sensing means, an enunciation is changed to denote intrusion, said alarm mode operating both when said container is still and when said container is in motion.

2. The modem of claim 1, wherein said first signal is transmitted via a system of cellular towers.

3. The modem of claim 1, wherein said first signal is transmitted via a system of radio towers.

4. The modem of claim 1, wherein said container comprises a box and said light shining on said light sensing means previously shielded from light is sensed when said box is opened.

5. The modem of claim 1, wherein said container comprises a suitcase.

6. The modem of claim 1, wherein said modem is battery powered.

7. The modem of claim 1, wherein said modem comprises a radio frequency modem.

8. The modem of claim 7, wherein said first signal is transmitted via a system of radio towers.

9. The modem of claim 1, wherein said plural sensing means comprises a trip wire.

10. The modem of claim 9, wherein said trip wire senses opening of a suitcase.

11. The modem of claim 9, wherein said trip wire is connected between said container and a stationary object whereby movement of said container with respect to said stationary object may be sensed.

12. A modem for intrusion and/or motion detection and tracking, comprising:

a) a radio frequency modem powered by a battery and removably attached within a container and always connected to said battery, said radio frequency modem being switchable between a sleep mode and an active mode;

b) said radio frequency modem including communication means for wirelessly transmitting a first signals via a system of cellular or radio towers to a remote receiver responsive to sensing one or more triggering conditions;

c) plural sensing means connected to said radio frequency modem for sensing said one or more triggering conditions, at least one of said one or more triggering conditions comprising motion of said container sensed by a trip wire having two ends connected to terminals on said communication means and a loop connected to said container, and at least another one of said one or more triggering conditions comprising intrusion into said container;

d) whereby, when said plural sensing means senses said one or more triggering conditions, including the breaking of said trip wire or disconnection of at least one of said two ends of said trip wire from one of said terminals, said plural sensing means sends a second signal to said radio frequency modem which, responsive thereto, switches from said sleep mode to said active mode and send said first signal to said remote receiver to notify said remote receiver that (1) said one or more triggering conditions has/have been sensed, and (2) identifying a particular triggering condition or particular triggering conditions from said one or more triggering conditions which has/have been sensed; and e) wherein said active mode comprises:

(1) a tracking mode in which any one of said plural sensing means is employed and signals no present intrusion, said tracking mode operating both when said container is still and when said container is in motion;

(2) a motion detecting mode that detects whether said container is still or in motion by notifying to the remote receiver when a change from still to moving or from moving to still has taken place; and (3) an alarm mode in which, responsive to actuation of any one of said plural sensing means, an enunciation is changed to denote intrusion, said alarm mode operating both when said container is still and when said container is in motion.

13. The modem of claim 12, wherein, responsive to sensing at least one of said one or more triggering conditions, said modem activates means for tracking a location of said container.

14. The modem of claim 12, wherein said container comprises a box or a suitcase and light shining on a light sensing means previously shielded from light is sensed when said box or suitcase is opened.

15. The modem of claim 12, wherein said plural sensing means solely comprise trip wires.

16. The modem of claim 12, wherein said one or more triggering conditions are chosen from the group consisting of said motion of said container, light shining on a sensor previously shielded from light, and said intrusion into said container.

17. The modem of claim 16, wherein said plural sensing means may sense all of said motion of said container, said light shining on said sensor previously shielded from light, and said intrusion into said container.

* * * * *